US006487803B1

(12) United States Patent
Yu

(10) Patent No.: US 6,487,803 B1
(45) Date of Patent: Dec. 3, 2002

(54) PUSH BUTTON FIREARM LOCK

(76) Inventor: Sandy Tai Sheung Yu, 9271 Kirkmond Crescent, Richmond, British Columbia (CA), V7E 1M7

( * ) Notice: Subject to any disclaimer, the term of this patent is extended or adjusted under 35 U.S.C. 154(b) by 0 days.

(21) Appl. No.: 09/483,763

(22) Filed: Jan. 14, 2000

(51) Int. Cl.[7] ..... F41A 17/46
(52) U.S. Cl. ..... 42/70.07; 42/70.11
(58) Field of Search ..... 42/70.06, 70.07, 42/70.11; 70/214

(56) References Cited

U.S. PATENT DOCUMENTS

| | | | | |
|---|---|---|---|---|
| 3,624,945 | A | | 12/1971 | Foote |
| 4,499,681 | A | * | 2/1985 | Bako et al. |
| 4,509,281 | A | | 4/1985 | Dreiling et al. |
| 4,748,833 | A | | 6/1988 | Nagasawa |
| 4,936,894 | A | | 6/1990 | Larson et al. |
| 5,050,328 | A | | 9/1991 | Insko |
| 5,400,538 | A | | 3/1995 | Shannon |
| 5,437,119 | A | | 8/1995 | Womack |
| 5,487,234 | A | | 1/1996 | Dragon |
| 5,515,633 | A | | 5/1996 | Harris |
| 5,535,605 | A | | 7/1996 | Werner |
| 5,551,181 | A | | 9/1996 | Upton |
| 5,561,935 | A | | 10/1996 | McCarthy et al. |
| 5,638,627 | A | * | 6/1997 | Klein et al. |
| 5,647,158 | A | * | 7/1997 | Eskelinen et al. |
| 5,704,152 | A | * | 1/1998 | Harrison et al. |
| 5,713,149 | A | * | 2/1998 | Cady et al. |
| 5,720,193 | A | | 2/1998 | Dick |
| D393,305 | S | | 4/1998 | Misner et al. |
| 5,832,647 | A | * | 11/1998 | Ling et al. |
| 5,899,102 | A | * | 5/1999 | Ling |
| 6,145,355 | A | * | 11/2000 | Burleigh et al. |

OTHER PUBLICATIONS

Speed Release Gun Lock publication from TVS Marketing at web page: www.speedreleasegunlock.com, 1998.*
Speed Release Gun Lock advertisement, TVS Marketing web site at http://www.gunlock@tvsmarketing.com, Jan. 12, 2000 (Author unknown).

* cited by examiner

*Primary Examiner*—Michael J. Carone
*Assistant Examiner*—Troy Chambers
(74) *Attorney, Agent, or Firm*—Kolisch Hartwell, P.C.

(57) ABSTRACT

A firearm lock apparatus having a bolt portion and a lock portion for engaging opposite sides of a trigger and trigger guard of a firearm. The bolt portion has a first trigger engagement surface and has a locking bolt extending from the trigger engagement surface. The lock portion has a second trigger engagement surface having a receptacle for receiving the locking bolt. A locking stem is situated in the receptacle for engaging the locking bolt to prevent separation of the locking bolt from the receptacle. A push button lock mechanism having pushbuttons and a release plate is also provided on the lock portion. The release plate is operable to move the locking stem into an unengaged position in which the locking bolt is separable therefrom when a pre-defined positioning of the pushbuttons is selected.

12 Claims, 7 Drawing Sheets

PUSH BUTTON FIREARM LOCK

BACKGROUND OF THE INVENTION

1. Field of the Invention

This invention relates to firearm locking devices and more particularly to a pushbutton firearm lock which engages and covers opposing sides of a trigger and trigger guard of a firearm.

2. Description of the Related Art

Many people collect firearms as a hobby or keep them for hunting or for self-defense. In the hands of a properly trained, authorized person a firearm presents virtually no threat. However, in the hands of a child or unauthorized person, a firearm can be a serious problem as the firearm can be operated unexpectedly or can be operated maliciously. For this reason, firearms are often kept in locked cabinets. This however, prevents firearm enthusiasts from closely inspecting and admiring them.

Unexpected or malicious operation of a firearm can be controlled by preventing operation of the firearm. If operation is prevented, the firearm need not be stored in a locked cabinet and can be closely inspected and passed from one person to another without danger. Even if the firearm lands in the hands of a criminal, if operation of the firearm is prevented, the firearm is of no use.

Various devices have been invented for preventing unauthorized operation of firearms. Many of these devices involve first and second lock portions which go on opposite sides of a trigger and trigger guard of a firearm and which are locked on the trigger and trigger guard to prevent access thereto. These types of devices prevent unauthorized operation by preventing access to the trigger, while still allowing other portions of the firearm to be exposed for viewing by a collector, for example.

The locking mechanisms employed on these types of devices however typically involve combination locks of the type employing a plurality of wheels which must be set to pre-defined positions to enable the lock to be opened. This can be a problem in areas of low lighting, where indicia on the wheels can be difficult to read. Other locks of this type employ keys, for example to open the lock. The use of keys requires that the key be readily available if the lock is to be readily opened.

Other types of locking devices such as the SPEED RELEASE GUN LOCK™ provided by TVS Marketing of Richardson, Texas, employ an electronic lock which may be susceptible to battery problems or moisture ingress for example, which may reduce the reliability of the device.

What would be desirable therefore is a mechanical firearm lock which prevents access to the trigger and which is easily and readily releasable, even in the dark. The present invention addresses this need.

SUMMARY OF THE INVENTION

The present invention addresses the above need by providing a firearm lock apparatus having a bolt portion and a lock portion for engaging opposite sides of a trigger and trigger guard of a firearm. The bolt portion has a first trigger engagement surface and has a locking bolt extending from the trigger engagement surface. The lock portion has a second trigger engagement surface having a receptacle for receiving the locking bolt. A locking stem is situated in the receptacle for engaging the locking bolt to prevent separation of the locking bolt from the receptacle. A push button lock mechanism having pushbuttons and a release plate is also provided on the lock portion. The release plate is operable to move the locking stem into an unengaged position in which the locking bolt is separable therefrom when a pre-defined positioning of the pushbuttons is selected.

Advantageously, a user can simply push the appropriate pushbuttons to permit the lock to be actuated by movement of the release plate thereby releasing the bolt portion from the lock portion to provide access to the trigger. The appropriate pushbuttons to press can be selected by a user, in the dark, for example, simply by feeling the lock portion to find the appropriate pushbuttons to press and pressing them.

Preferably, the release plate has an integral actuator member extending from the lock portion and operable to be moved relative to the lock portion by a user of the apparatus, to move the release plate to move the actuator into the unengaged position.

To facilitate control of the release plate with the pushbuttons, each of the pushbuttons may have a release plate movement control portion for selectively freeing and blocking the release plate in response to positioning of the pushbutton. At least some of the pushbuttons may be movable into an actuated position in which the release plate is operable to move relative to the pushbuttons.

Preferably, the pushbutton lock includes a guide member for guiding the pushbuttons in movement between reset and actuated positions and the guide member includes openings for guiding the pushbuttons in movement generally perpendicular to movement of the release plate.

It is desirable that the lock mechanism further comprises a reset plate adjacent the release plate and each of the pushbuttons has a reset plate engagement portion for cooperating with the release plate to hold the pushbutton in the actuated position. Preferably, the reset plate has an integral actuator member extending from the lock portion and operable to be moved relative to the lock portion by a user of the apparatus to move the reset plate to release the pushbuttons to their unactuated positions.

To facilitate more complexity in the lock the lock mechanism includes a blocking member actuable between a blocking position for blocking movement of the release plate and a movement position for permitting movement of the release plate. Preferably the blocking member is slidable between the blocking position and the movement position.

To facilitate fast ejection of the bolt portion from the lock portion the apparatus preferably has a spring for ejecting the locking bolt from the receptacle when the locking stem is moved into the unengaged position.

In accordance with another aspect of the invention, there is provided a method of releasing a firearm lock. Generally, the method involves ejecting a locking bolt of a bolt portion of a lock positioned on one side of a trigger of the firearm, from a lock portion of the lock positioned on an opposite side of the trigger, in response to actuation of an actuator integral with a release plate of the lock, which is rendered operable to be moved when a plurality of pushbuttons on the lock are set in pre-defined positions.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
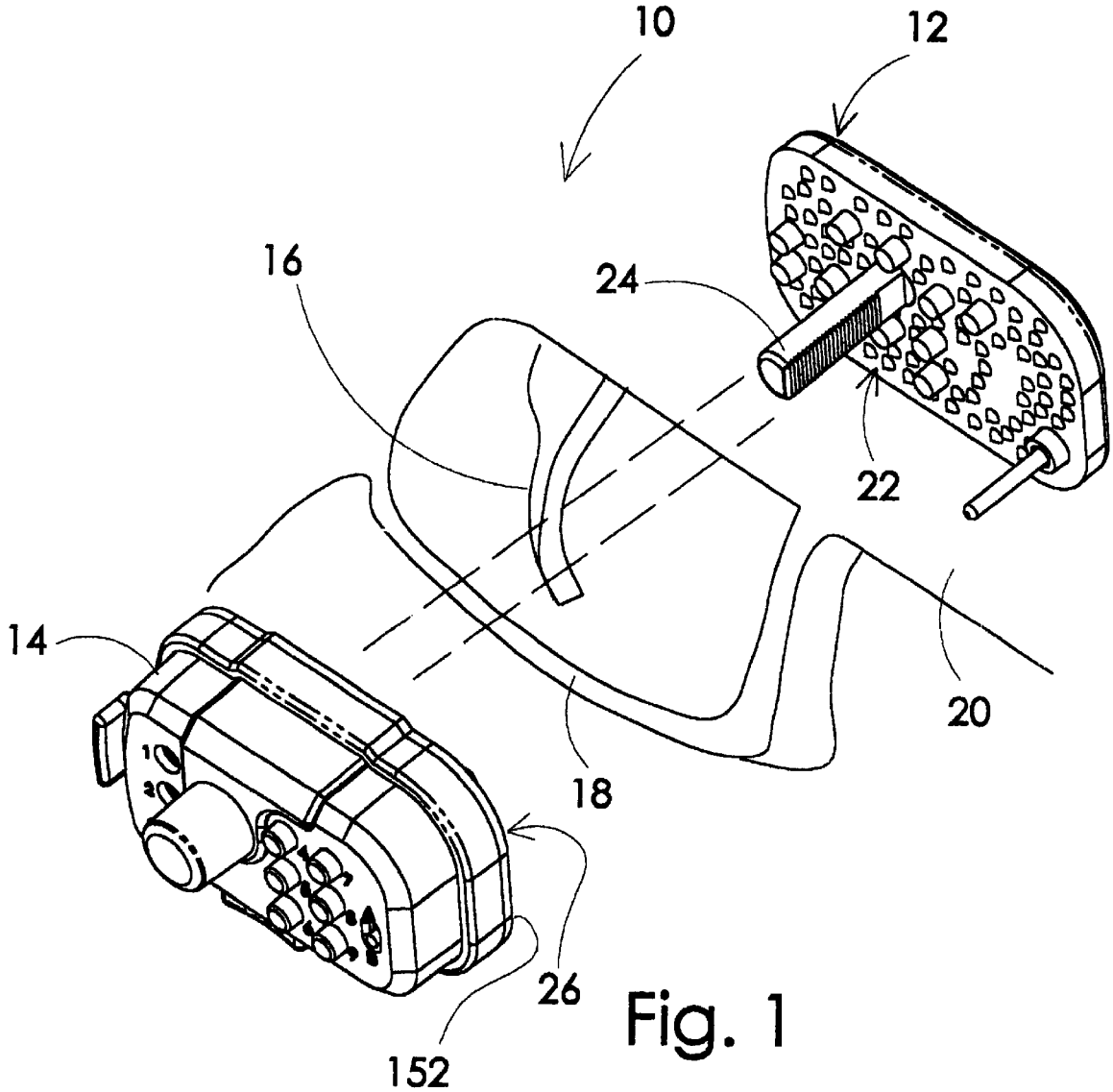
FIG. 1 is a fragmented perspective view of a firearm lock apparatus according to a first embodiment of the invention.
Figure 2:
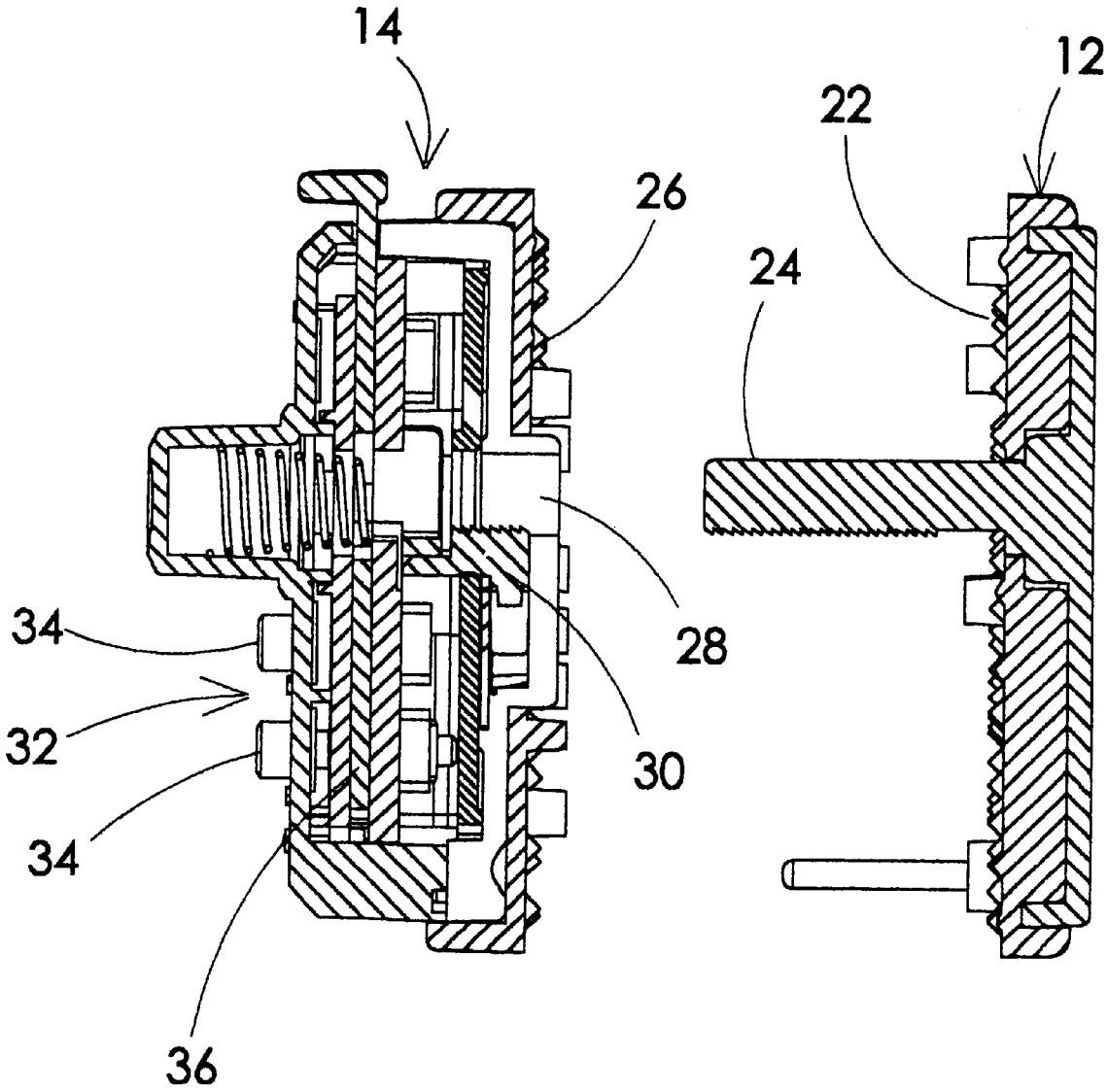
FIG. 2 is a cross-sectional view of the firearm lock apparatus shown in FIG. 1.

Referring to FIG. 1, a firearm lock apparatus according to a first embodiment of the invention is shown generally at 10. The apparatus has a bolt portion 12 and a lock portion 14 for engaging opposite sides of a trigger 16 and trigger guard 18 of a firearm 20. The bolt portion 12 has a first trigger engagement surface 22 and has a locking bolt 24 extending from the first trigger engagement surface 22. Referring to FIG. 2, the lock portion 14 has a second trigger engagement surface 26 having a receptacle 28 for receiving the locking bolt 24. A locking stem 30 is located in the receptacle 28 for engaging the locking bolt 24 to prevent separation of the locking bolt 24 from the lock portion 14. The lock further includes a push button lock mechanism shown generally at 32 having pushbuttons 34 and a release plate 36. The release plate 36 is operable to move the locking stem 30 into an unengaged position in which the locking bolt 24 is separable from the locking stem 30 when a pre-defined positioning of the pushbuttons 34 is selected.

Effectively, a user can simply push the appropriate pushbuttons 34 to permit the lock to be actuated by movement of the release plate 36 thereby releasing the bolt portion 12 from the lock portion 14 to provide access to the trigger. The appropriate pushbuttons 34 to press can be selected by a user, in the dark, for example, simply by feeling the lock portion 14 to find the appropriate pushbuttons 34 to press and pressing them.

Figure 3:
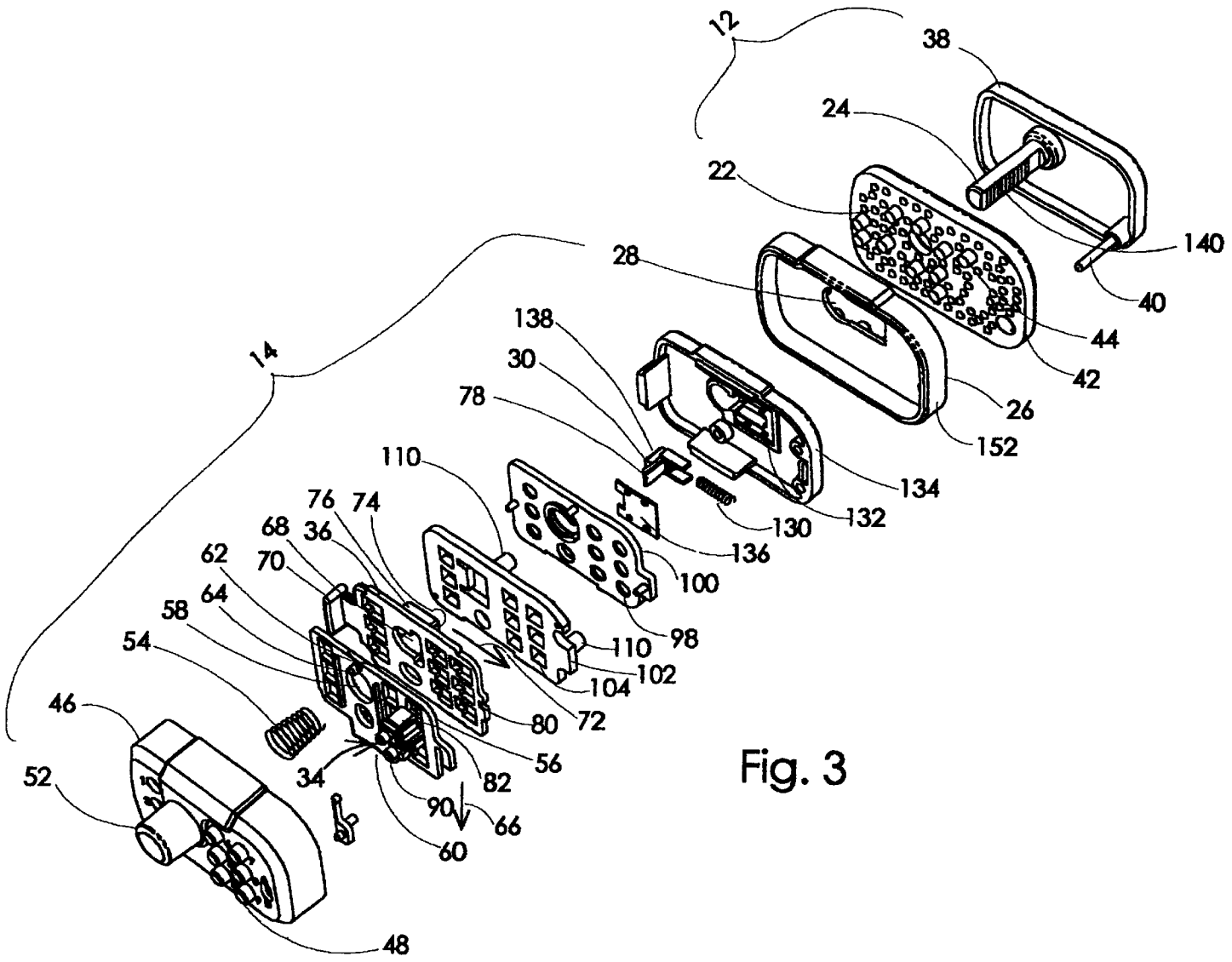
FIG. 3 is an exploded isometric view of the firearm lock apparatus.

Referring to FIG. 3, in this embodiment, the bolt portion 12 is formed from a block of aluminum to include an elongated relatively flat planar portion 38 from which the locking bolt 24 extends in a direction perpendicular to a plane in which the planar portion lies. Alternatively, the block can be made of other types of material such as a polymer or steel, for example. Preferably, the locking bolt is oval shaped to assist in the alignment of the locking portion 14 and the bolt portion 12. An anchor pin 40 is also secured to the block to extend generally parallel to and spaced apart from the locking bolt 24. A loop of wire (not shown) may be secured to the alignment pin to tether the lock apparatus and firearm to which it is attached to a secure object such as table, for example.

The first trigger engagement surface 22 is formed on a piece of elastomeric material 42 shaped to receive and secure to the planar portion 38. In this embodiment the first trigger engagement surface 22 includes a plurality of spaced apart protrusions 44 which extend in a direction parallel to the locking bolt 24 to engage the trigger 16 and trigger guard 18 of the firearm 20 therebetween. The elastomeric material 42 is also resilient in that it can be resiliently deformed onto the trigger 16 and trigger guard 18 to provide a snug fit of the bolt portion 12 onto the trigger 16 and trigger guard 18 when the lock is in use.

In this embodiment, the lock portion includes a lock housing 46 formed from a block of aluminum to include a plurality of pushbutton openings 48 and a bolt cover 52. A tapered ejection spring 54 is received and held in the bolt cover 52, for ejecting the locking bolt 24 from the receptacle 28 when the locking stem 30 is moved into the unengaged position to facilitate fast ejection of the bolt portion 12 from the lock portion 14.

The lock mechanism further comprises a reset plate 56 which is received and guided for movement in the lock housing 46 in such a manner that an opening 58 in the reset plate is generally aligned with the bolt cover 52 and such that an actuator 60 integral with the reset plate 56 extends outside the lock housing 46 to enable actuation by a user of the lock. In this embodiment, a spring 62 is mounted on a boss 64 extending from the reset plate 56 to bear upon an inner portion (not shown) of the lock housing 46 to urge the reset plate 56 in the direction of arrow 66 into an unactuated position.

The release plate 36 is located adjacent the reset plate 56 such that a bolt receiving opening 68 thereof is generally aligned with the opening 58 in the reset plate 56. The release plate 36 has an integral actuator member 70 extending from the lock portion outside the lock housing 46 and operable to be moved relative to the lock housing by a user of the apparatus to move the release plate in a direction indicated by arrow 72 to move the locking stem 30 into the unengaged position. Movement of the locking stem 30 is effected by engagement of a contact surface 74 of a wall 76 formed on three sides of the bolt receiving opening 68 with a corresponding contact surface 78 of the locking stem 30, when the release plate is moved in the direction of arrow 72. The release plate 36 further has a plurality of openings 80 having a notched rectangular shape as shown at 80 in FIG. 4, for receiving portions of the push buttons 34.

Figure 5:
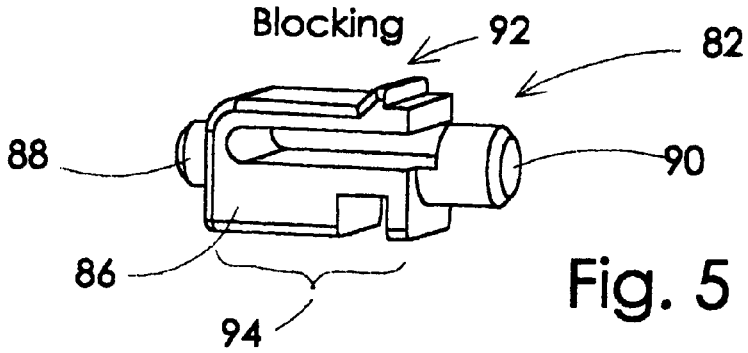
FIG. 5 is an isometric view of a blocking push button of the apparatus shown in FIG. 1.
Figure 6:
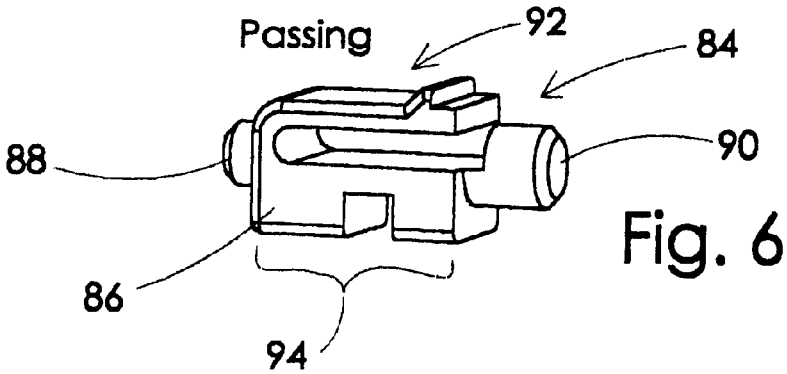
FIG. 6 is an isometric view of a passing push button of the apparatus shown in FIG. 1.

Referring to FIGS. 5 and 6, two types of pushbuttons are shown. FIG. 5 shows a blocking pushbutton at 82 and FIG. 6 shows a passing pushbutton at 84. Each type of pushbutton is similar in that they both have a body portion 86 with a spring retainer 88 and actuator 90 extending coaxially in opposite directions, and a retainer portion 92 extending adjacent the body portion 86. The body portion 86 has a release plate movement control portion 94 for selectively freeing and blocking the release plate in response to positioning of the pushbutton and the retainer portion 92 cooperates with the reset plate 56 to hold the pushbutton in an actuated position.

Referring to FIG. 3, the passing and blocking types of pushbuttons are shown in relation to the remaining components of the lock portion 14. The actuators 90 of the pushbuttons 82 and 84 protrude through the openings 48 in the lock housing 46 while the spring retainers (not shown in FIG. 3) are fitted with springs (not shown in FIG. 3) which are received against corresponding depressions 98 in a support plate 100. A guide plate 102 is positioned between the support plate 100 and the release plate 36 and has openings 104 to guide the pushbuttons in movement perpendicular to the directions of movement of the reset plate 56 and the release plate 36 indicated by arrows 66 and 72, respectively.

Figure 7:
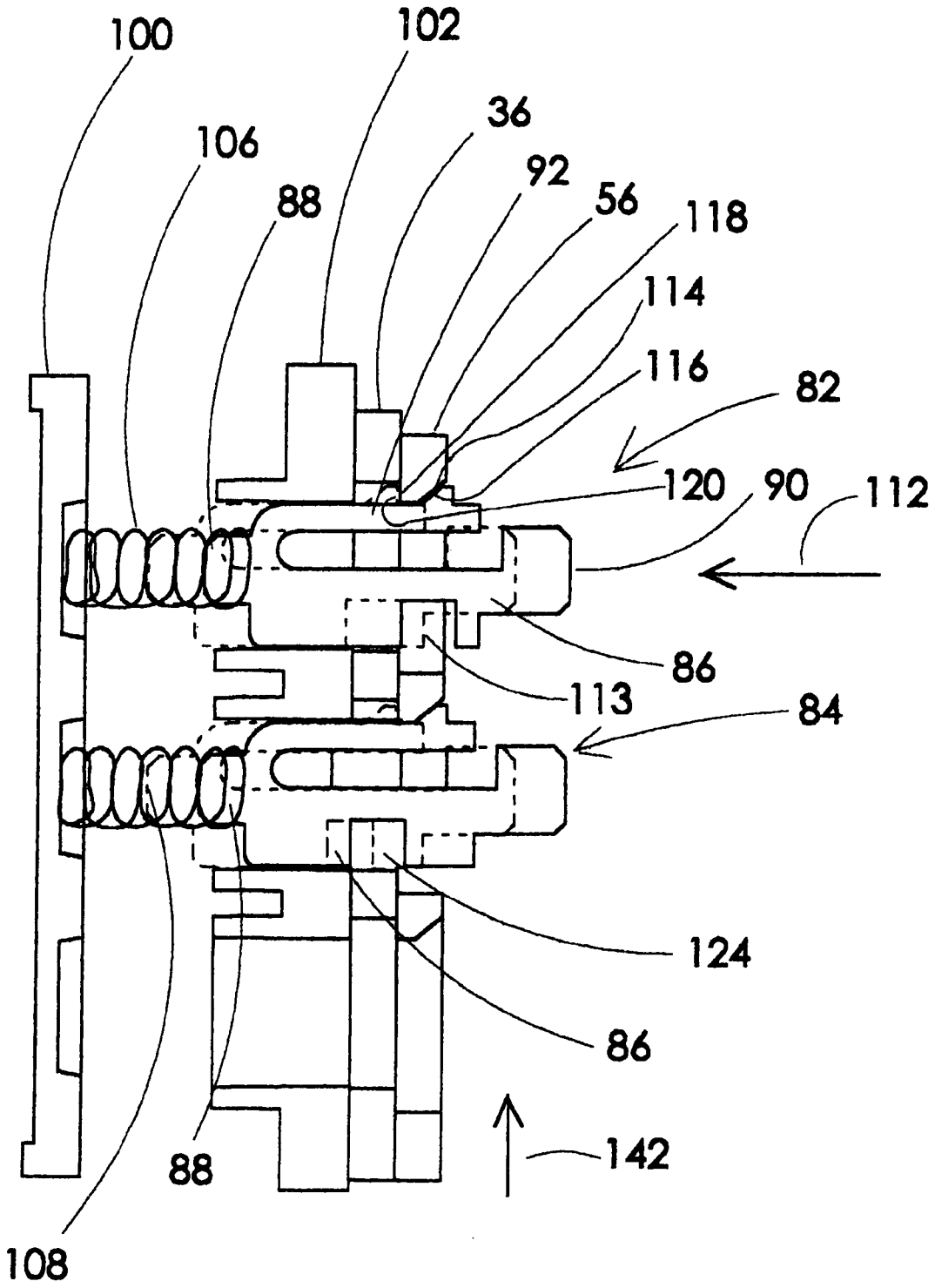
FIG. 7 is a simplified cross-sectional view of a plurality of plates and push buttons of the apparatus shown in FIG. 1, illustrating cooperation between the push buttons and the plates.

The positioning and movement of the pushbuttons relative to the support plate 100, the guide plate 102, the release plate 36 and the reset plate 56 is seen best in FIG. 7. It will be appreciated that the guide plate 102, release plate 36 and the reset plate 56 are sandwiched together, whereas the support plate 100 is spaced apart from the guide plate to accommodate springs 106 and 108 which are positioned on the spring retainers 88 of the pushbuttons and extend between the pushbuttons and the support plate 100. Referring briefly to FIG. 3, the support plate 100 is held in spaced apart relation relative to the guide plate by spacers 110 formed in the guide plate 102.

Referring back to FIG. 7, the pushbuttons are shown in their unactuated positions in solid outline and in their actuated positions in broken outline. To move a pushbutton from the unactuated position to the actuated position, the actuator 90 of the pushbutton, which extends through the corresponding opening in the lock housing (not shown in FIG. 7) is pushed in the direction of arrow 112, against the action of the spring 106 or 108. As the pushbutton is moved, opposing camming surfaces 114 and 116 on the retainer portion 92 and the reset plate 56, respectively cause the retainer portion 92 to resiliently deflect from an undeflected position toward the body portion 86 to permit the retainer portion to pass through the opening in the reset plate 56. When the retainer portion 92 has passed fully through the opening, it moves back to its undeflected position, whereupon a locking edge 118 of the retainer portion 92 abuts a marginal edge 120 extending about the opening in the reset plate. The locking edge 118 is maintained in contact with the marginal edge 120 by the action of the spring 106 or 108. Thus, the pushbutton is held in the actuated position by the spring 106 and the abutting locking edge 118 and marginal edge 120.

Figure 4:
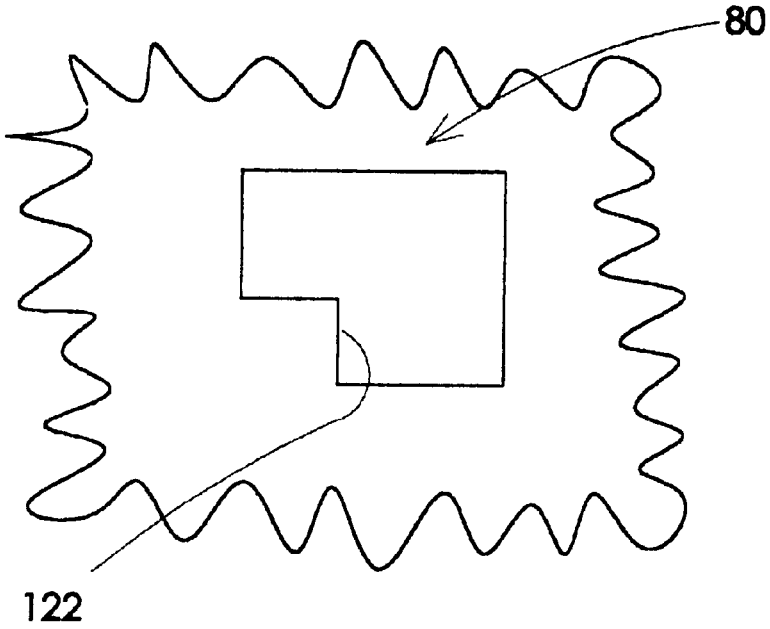
FIG. 4 is a fragmented plan view of an opening in a release plate of the apparatus shown in FIG. 1.
Figure 8:
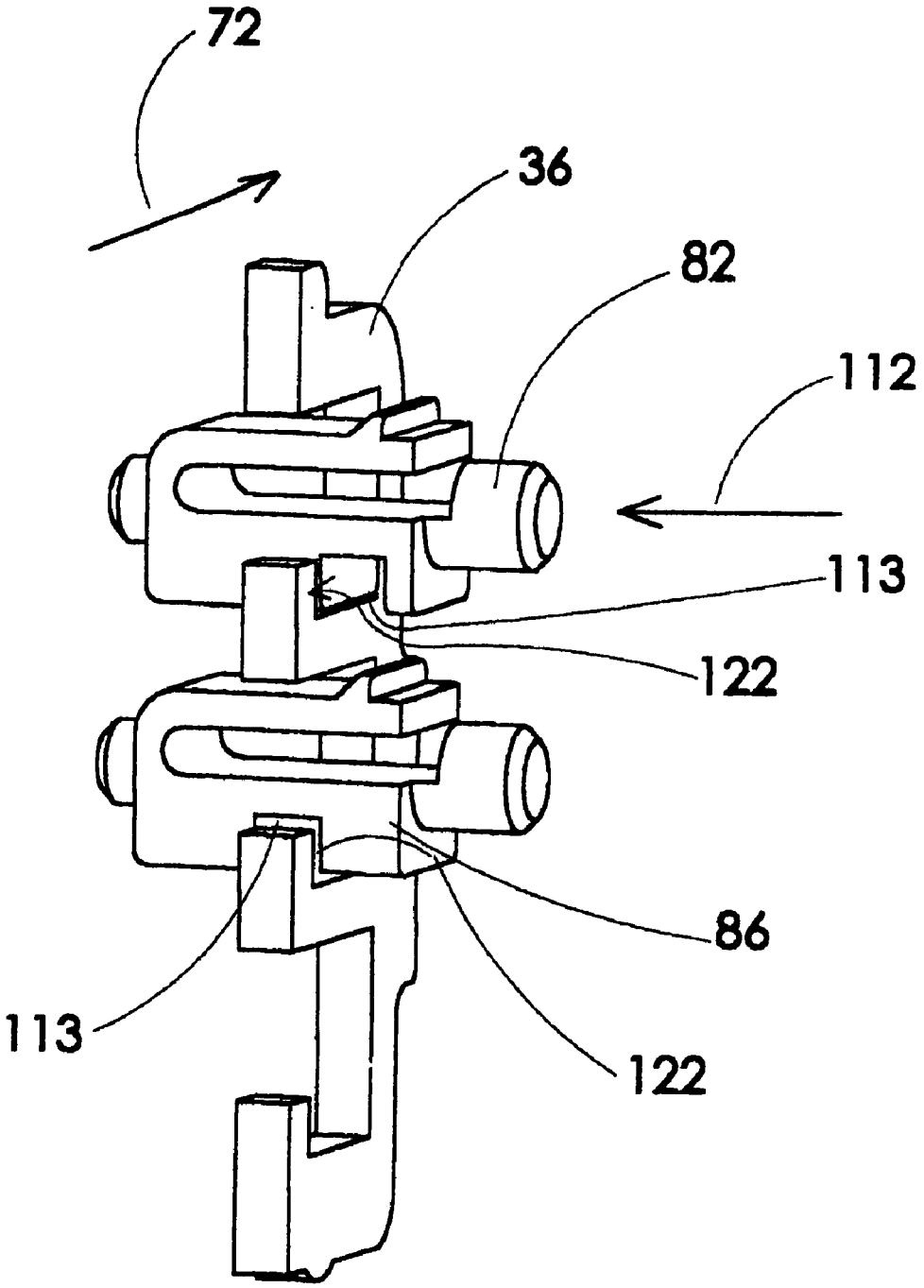
FIG. 8 is a simplified fragmented perspective view of push buttons and a release plate of the apparatus shown in FIG. 1.

When the blocking pushbutton 82 is in the unactuated position, the release plate movement control portion 94 blocks movement of the release plate 36. This is seen best in FIG. 8, where it can be seen that the release plate 36 is prevented from moving in the direction of arrow 72 because an engagement surface 122, seen best in FIG. 4 is blocked by the body portion 86 of the pushbutton. It can readily be seen that if the pushbutton is moved in the direction of arrow 112 until a slot 113 in the body portion 86 is aligned with the release plate 36, movement of the release plate 36 in the direction of arrow 72 is permitted. This position of the pushbutton in which the release plate 36 is operable to be moved is the actuated position shown in FIG. 7. In general, when a blocking pushbutton 82 is moved into its actuated position, a slot 113 in the pushbutton is aligned with the release plate 36 to permit the release plate to move in the direction of arrow 72.

Still referring to FIG. 7, the passing pushbutton 84 is shown in an unactuated position in which a slot 124 in the body portion 86 is already aligned with the release plate 36. If the passing pushbutton 84 is moved to an actuated position in which the passing pushbutton is moved in the direction of arrow 112, the slot 124 is no longer aligned with the release plate 36 and the release plate is prevented from moving. Perhaps this is seen best in FIG. 8, where it can be seen that if the passing pushbutton 84 is pushed inwardly, the engagement surface 122 of the opening through which the passing pushbutton 84 extends is blocked by the body portion 86 of the passing pushbutton 84. Thus a passing pushbutton must not be moved into its actuated position to permit movement of the release plate 36. The passing pushbutton is locked in its actuated position in the same manner as that described for the blocking pushbutton above.

From the foregoing, it will be appreciated that where a lock of the type described herein includes a plurality of passing and blocking pushbuttons, it will be necessary to actuate the blocking pushbuttons and leave the passing pushbuttons unactuated in order to be able to move the release plate 36 into a position in which the locking stem 30 is moved out of engagement with the locking bolt 24. Referring to FIGS. 1 and 3, it can be seen that in this embodiment, there are nine pushbuttons and any of these can be a blocking or passing pushbutton. Thus there is a large plurality of different combinations that can be made with a lock according to the present embodiment.

When the appropriate combination has been set by actuating appropriate pushbuttons, the user can press the release plate actuator 70 shown in FIG. 3, to move the release plate 36 in the direction indicated by arrow 72, whereupon the contact surface 74 contacts the surface 78 of the locking stem 30, causing the locking stem to slide in the same direction indicated by arrow 72, against the force of a spring 130. Movement of the locking stem is guided by grooves 132 in a housing cover 134 and a retainer plate 136 secured to the cover to form a receptacle in which the spring 130 is held.

When the locking stem is slid in the indicated direction, teeth 138 on the locking stem 30 disengage with complementary teeth 140 on the locking bolt 24 and the spring 54 ejects the bolt from the receptacle causing the bolt portion 12 to separate from the lock portion 14. The firearm is thus rendered free of the lock apparatus and is operable to be used.

The lock portion 14 may then be reset by pushing the reset plate actuator 60, which causes the reset plate to move in a direction opposite to the direction indicated by arrow 66, against the action of the spring 62. Referring to FIG. 7, the reset plate moves in the direction of arrow 142 which slides the reset plate such that the marginal edge 120 is moved out of abutting relation with the locking edge 118 of the retainer portion 92, thereby permitting the springs 106 and 108 to move the pushbuttons 82 and 84 in a direction opposite to that indicated by arrow 112, to return them to their unactuated positions. Thus a simple actuation of the reset plate actuator 60 shown in FIG. 3, acts to reset all of the actuated pushbuttons to their unactuated positions. When the pushbuttons are in their unactuated positions, the lock portion 14 is operable to receive the locking bolt 24 to resume a locking configuration about the trigger and trigger guard of the firearm.

The locking configuration is resumed by placing the second trigger engagement surface 26 of a second elastomeric cover 152 on the cover 134 against the trigger 16 and trigger guard 18 as shown in FIG. 1. The bolt portion 12 is then moved into a position in which the locking bolt 24 is received in the receptacle 28 shown in FIG. 3. On insertion of the bolt into the receptacle, the teeth 138 on the locking stem 30 engage the complementary teeth 140 on the locking bolt 24. It will be appreciated that the teeth 138 and 140 are cammed to permit movement of the locking bolt 24 into the receptacle 28 while preventing movement of the locking bolt 24 out of the receptacle 28. Thus, the locking bolt 24 can only move in one direction—into the receptacle 28. As the locking bolt 24 is received in the receptacle 28, the locking stem 30 is moved against the action of the spring 130 whereby the spring maintains a constant urging of the locking stem teeth 138 against the complementary teeth 140 on the locking bolt 24. When the locking bolt 24 has been received in the receptacle 28 until the first and second first and second trigger engagement surfaces 22 and 26 are in tight contact with the trigger 16 and trigger guard 18 shown in FIG. 1, the lock is in a locking position in which the trigger 16 cannot be accessed and operation of the firearm is impossible.

Figure 10:
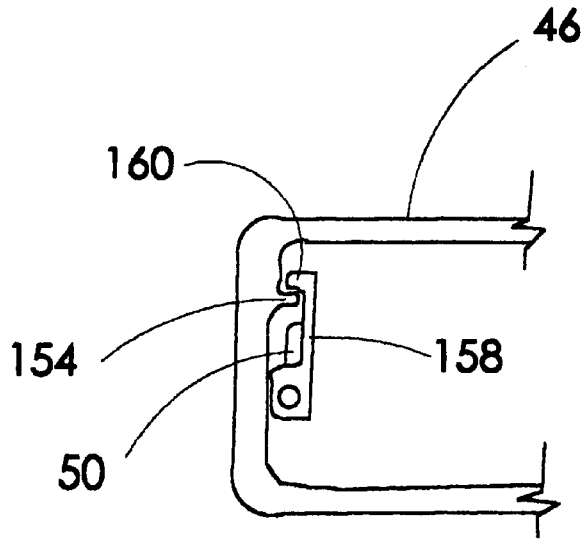
FIG. 10 is a fragmented plan view of a housing of the lock portion shown in FIG. 9.
Figure 9:
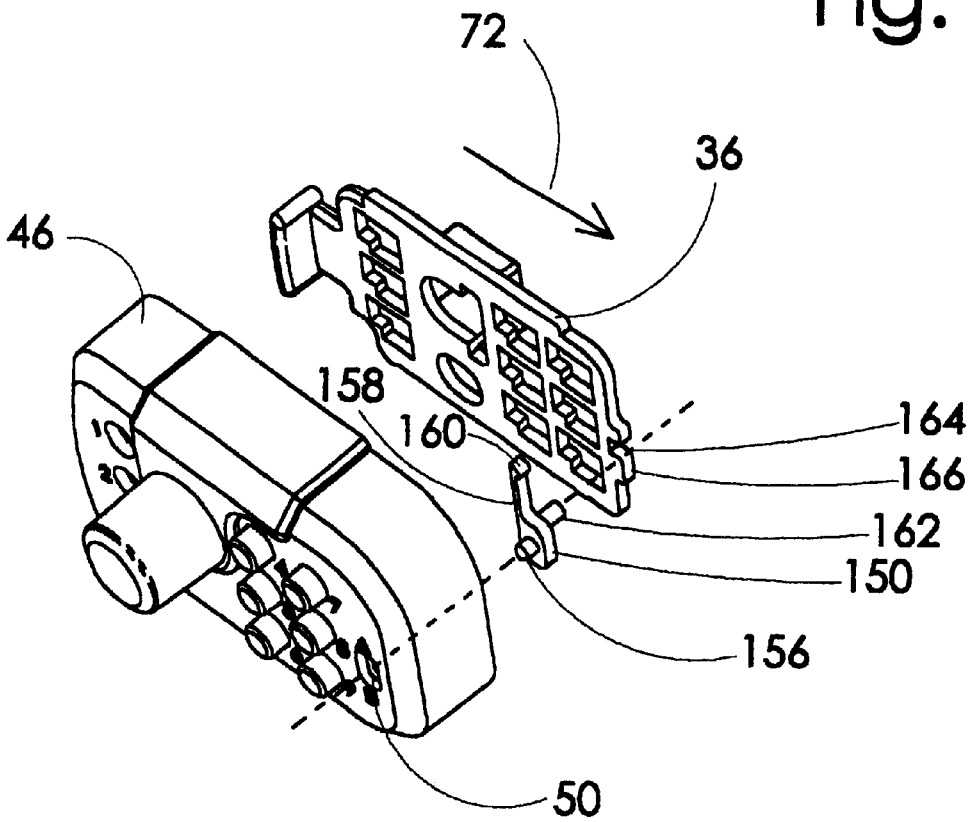
FIG. 9 is an exploded isometric view of a lock portion according to a second embodiment of the invention.

Referring to FIG. 9, in an alternative embodiment, the lock housing 46 includes an elongated opening 50 and the apparatus further comprises a blocking member 150 actuable between a blocking position for blocking movement of the release plate 36 and a movement position for permitting movement of the release plate 36. Referring to FIGS. 9 and 10 to accommodate the blocking member 150, the lock housing is formed to include a detent 154 adjacent the elongated opening 50. The blocking member 150 has a first pin 156 which is received in the elongated opening 50 and guided for sliding movement therein. The blocking member further has a detent arm 158 having a detent end 160 which engages the detent 154 in the lock housing 46 to hold the blocking member in a first position as shown in FIG. 10, in which the detent end 160 is above the detent 154 in the lock housing 46 and a second position (not shown) in which the detent end 160 is below the detent 154.

The blocking member 150 further has a second pin 162 which extends in a direction opposite to the first pin 156 to move into or out of alignment with a slot 164 in the release plate 36. The blocking member 150 is dimensioned such that when the blocking member 150 is in the first position, the second pin 162 is aligned with the slot 164 and when the blocking member 150 is in the second position, the second pin 162 is not aligned with the slot 164. When the blocking member is aligned with the slot 164, the release plate 36 may be actuated in the manner described above to move the release plate 36 in the direction indicated by arrow 72, whereupon the second pin 162 is received in the slot 164. When the blocking member is not aligned with the sot 164, an edge 166 of the release plate 36 abuts the second pin 162, preventing movement of the release plate 36 in the direction of arrow 72. Thus, even though each of the appropriate pushbuttons may be actuated, the release plate 36 still cannot be moved because the second pin 162 is blocking it. Thus it will be appreciated that the blocking member 150 of this embodiment must be placed in the appropriate position to permit movement of the release plate 36. Thus in effect, an appropriate combination of actuation of the pushbuttons and the blocking member is required to open the lock. It will be appreciated that use of the blocking member described herein doubles the number of combinations provided by the push buttons alone.

It will be appreciated that to further increase the number of combinations, more blocking members may be employed or more pushbuttons may be employed, or more of both blocking members and pushbuttons may be employed.

While specific embodiments of the invention have been described and illustrated, such embodiments should be considered illustrative of the invention only and not as limiting the invention as construed in accordance with the accompanying claims.

What is claimed is:

1. A firearm lock apparatus comprising:

a) a bolt portion having a first trigger engagement surface and a locking bolt extending from said trigger engagement surface;

b) a lock portion having:

i) a second trigger engagement surface having a receptacle for receiving said locking bolt;

ii) a locking stem in said receptacle for engaging said locking bolt to prevent separation of said locking bolt from said locking stem; and iii) a push button lock mechanism having pushbuttons mechanically engageable with a release plate, said release plate being operable to move said locking stem into an unengaged position in which said locking bolt is separable from said locking stem when a pre-defined positioning of said pushbuttons is selected.

2. The apparatus claimed in claim 1 wherein said release plate has an integral actuator member extending from the lock portion and operable to be moved relative to the lock portion by a user of the apparatus to move said release plate to move said actuator into said unengaged position.

3. The apparatus claimed in claim 1 wherein each of said pushbuttons has a release plate movement control portion for selectively freeing and blocking said release plate in response to positioning of said pushbutton.

4. The apparatus claimed in claim 3 wherein at least some of said pushbuttons are movable into an actuated position in which said release plate is operable to move relative to said at least some of said pushbuttons.

5. The apparatus claimed in claim 4 wherein said pushbutton lock includes a guide member for guiding said pushbuttons in movement between reset and actuated positions.

6. The apparatus claimed in claim 5 wherein said guide member includes openings for guiding said pushbuttons in movement generally perpendicular to movement of said release plate.

7. The apparatus claimed in claim 5 wherein said lock mechanism further comprises a reset plate adjacent said release plate and wherein each of said pushbuttons has a reset plate engagement portion for cooperating with said release plate to hold said pushbutton in said actuated position.

8. The apparatus claimed in claim 7 wherein said reset plate has an integral actuator member extending from the lock portion and operable to be moved relative to the lock portion by a user of the apparatus to move said reset plate to release said pushbuttons to their unactuated positions.

9. The apparatus claimed in claim 7 wherein said lock mechanism includes a blocking member actuable between a blocking position for blocking movement of said release plate and a movement position for permitting movement of said release plate.

10. The apparatus as claimed in claim 9 wherein said blocking member is slidable between said blocking position and said movement position.

11. The apparatus claimed in claim 1 further comprising a spring for ejecting said locking bolt from said receptacle when said locking stem is moved into said unengaged position.

12. A method of releasing a firearm lock, the method comprising ejecting a locking bolt of a bolt portion of a lock positioned on one side of a trigger of the fire arm, from a lock portion of said lock positioned on an opposite side of the trigger, in response to actuation of an actuator integral with a release plate of said lock, which is rendered operable to be moved when a plurality of pushbuttons on said lock are set in a pre-defined position and mechanically engaged therewith.

* * * * *